US005129831A

United States Patent [19]

Locati

[11] Patent Number: 5,129,831

[45] Date of Patent: Jul. 14, 1992

[54] RIGHT ANGLE HEADER SHROUD TO BOARD POLARIZATION AND KEYING SYSTEM

[75] Inventor: Ronald P. Locati, Harrisburg, Pa.

[73] Assignee: AMP Incorporated, Harrisburg, Pa.

[21] Appl. No.: 736,160

[22] Filed: Jul. 26, 1991

[51] Int. Cl.[5] ..... H01R 9/09

[52] U.S. Cl. ..... 439/79; 439/680; 439/374

[58] Field of Search ..... 439/79, 374, 377, 633, 439/680, 681

[56] References Cited

U.S. PATENT DOCUMENTS

| | | | |
|---|---|---|---|
| 3,264,599 | 8/1966 | Kinkaid . | |
| 3,325,771 | 6/1967 | Ruehlemann et al. . | |
| 3,474,395 | 10/1969 | Ferdon et al. . | |
| 3,518,620 | 6/1970 | Bushey et al. . | |
| 3,601,770 | 8/1971 | Bowley . | |
| 3,685,001 | 8/1972 | Krafthefer . | |
| 3,768,066 | 10/1973 | Mattingly, Jr. et al. . | |
| 3,822,416 | 7/1974 | Haag et al. | 439/377 |
| 3,966,290 | 6/1976 | Little et al. . | |
| 4,193,108 | 3/1980 | Romano | 361/399 |
| 4,204,737 | 5/1980 | Faber et al. . | |
| 4,350,409 | 9/1982 | Kato et al. . | |
| 4,530,561 | 6/1985 | Tyree et al. . | |
| 4,586,254 | 5/1986 | Ammon et al. | 29/884 |
| 4,603,929 | 8/1986 | Fitzpatrick . | |
| 4,664,462 | 5/1987 | Owens . | |
| 4,929,183 | 5/1990 | Rinneburger | 439/67 |
| 5,035,641 | 7/1991 | Van Santbrink et al. | 439/329 |
| 5,037,323 | 8/1991 | Locati | 439/374 |

FOREIGN PATENT DOCUMENTS

| | | | |
|---|---|---|---|
| 0201686 | 2/1987 | European Pat. Off. . | |
| 0342873 | 11/1989 | European Pat. Off. | 439/79 |
| 6503360 | 9/1965 | Netherlands . | |
| 2214729 | 9/1989 | United Kingdom | 439/79 |

OTHER PUBLICATIONS

IBM Technical Disclosure Bulletin vol. 33, No. 1A, Jun. 1990.

AMP Catalog No. 73-177, p. 9, streamlined Mar. 1989.

*Primary Examiner*—Gary F. Paumen

*Assistant Examiner*—Khiem Nguyen

*Attorney, Agent, or Firm*—David L. Smith

[57] ABSTRACT

An alignment and blind mate assist shroud (22) is disclosed having a body portion (64) securable to a right angle connector (20) thereby forming an assembly (116). The alignment and blind mate assist shroud (22) also has an extension portion that extends above the shroud (62) of connector (20) to assist in aligning a complementary connector during mating. The body portion (64) also has a keying protrusion (24,24',24'',24''') adapted to extend beyond the mounting face (41) of the connector housing (26) to key the connector assembly (116) to a particular location on a circuit board (122). The keying protrusion (24,24',24'',24''') cooperates with a notch (118,118',118'',118''') in an edge of the circuit board (122) on which the right angle connector assembly (116) is adapted to be mounted to assure that the appropriate right angle connector assembly (116) is mounted to the corresponding location on the circuit board (122).

15 Claims, 5 Drawing Sheets

RIGHT ANGLE HEADER SHROUD TO BOARD POLARIZATION AND KEYING SYSTEM

BACKGROUND OF THE INVENTION

This invention relates to electrical connectors and in particular to a shroud for securing to a right angle electrical connector, forming a connector assembly, to key the right angle connector assembly to one of several locations on a circuit board The shroud has a protrusion receivable in a notch in an edge of the circuit board on which the connector assembly is mounted to assure that the appropriate connector assembly is positioned at the corresponding appropriate one of several possible locations for such right angle connector assemblies on the circuit board.

Alignment and blind mate assist shrouds securable to a connector to form a connector assembly for mounting to a circuit board are known. One application has required that several such connector assemblies be mounted to a single circuit board. In an effort to assist those persons to assemble the mating or complimentary connectors to the various connector assemblies on a single board to correlate a particular mating connector to the intended one of the several possible connector assemblies, the pair of shrouds secured to each connector on the board have been made of various colors of plastic such as yellow, red, white, grey, green or blue. That is, each connector has secured to it two shrouds of a single particular color so as to color code each connector assembly by the color of the shrouds. While this approach was successful to help those who assembled the mating connectors to the various connector assemblies by permitting the mating connector assembler to select the proper one of the assemblies to mate a particular mating connector to by color, it was successful only if the connector assembly having the appropriate color shrouds was positioned at the corresponding location on the circuit board during stuffing of the components thereon. Since each of the shrouds was identical to the other shrouds, but for color, there was always the possibility than an error could be made in positioning a connector assembly having shrouds of the wrong color at a particular assembly receiving position on a circuit board. This could then lead to the wrong mating connector being mated thereto.

There is disclosed in U.S. Pat. No. 4,507,861 a tool for grasping then stuffing rectangular electrical components on a circuit board. The tool has foot-like extensions for grasping the electronic component at each of the corners. Three of the four foot-like extensions have locator pins receivable in apertures in the printed circuit board to provide a polarization feature to assure that the tool stuffs the component on the circuit board with a particular orientation.

U.S. Pat. No. 4,744,140 discloses a tool for mounting connectors onto a circuit board. The tool includes a pair of pins, one of smaller diameter and one of larger diameter, which pass through holes in the connector to be mounted then into corresponding apertures in the printed circuit board. The tool provides for the connector to be received on the pins in only one orientation and, since the board is provided with holes identically sized to the pins and precisely located, the connector is positioned on the board by the tool in a predetermined orientation that accurately pilots the connector leads into plated through holes in the circuit board.

SUMMARY OF THE INVENTION

In accordance with the present invention, an alignment and blind mate assist shroud having a body portion securable to a right angle connector housing thereby forming an assembly has a keying protrusion adapted to extend beyond the mounting face of the connector housing to key the connector assembly to a particular location on a circuit board. The keying protrusion cooperates with and is received in a notch in an edge of the circuit board on which the right angle connector assembly is adapted to be mounted to assure that the appropriate right angle connector assembly is mounted to the corresponding location on the circuit board.

DESCRIPTION OF THE PREFERRED EMBODIMENT

Figure 1:
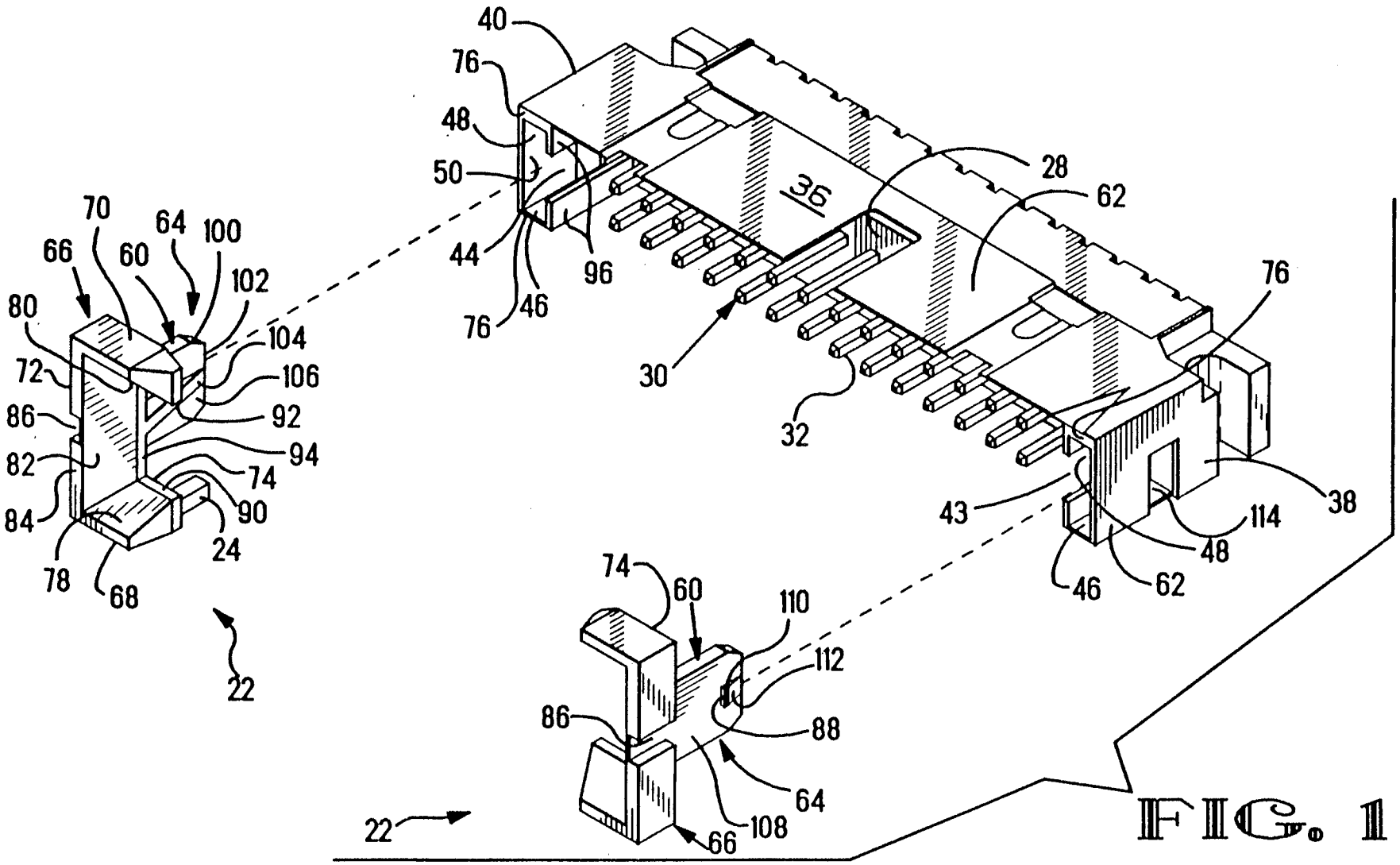
FIG. 1 is a perspective view of a right angle pin header having two alignment and blind mate assist shrouds securable to the header exploded therefrom, one of the shrouds having a keying protrusion in accordance with the present invention.

FIG. 1 illustrates a right angle pin header 20 having a pair of blind mate assist shrouds 22 at least one of which has a polarization or keying protrusion 24 thereon in accordance with the present invention. Right angle pin header 20 includes a housing 26 molded of a suitable plastic having a base 28 in which pins 30 are secured and through which pins 30 extend. On one side of base 28 pins 30 extend normal to base 28 and form a pin mating portion 32. On the other side of base 28 the pins 30 include a right angle bend forming solder tail portions 34. Housing 26 has side wall 36 and end walls 38 and 40. A side edge of base 28 forms a mounting face 41 which may have standoffs 42 (FIG. 4) as is known in the art thereby defining a mounting face at the distal ends thereof. This side of the housing may be opened as shown, or have an enclosing side wall (not shown).

Figure 2:
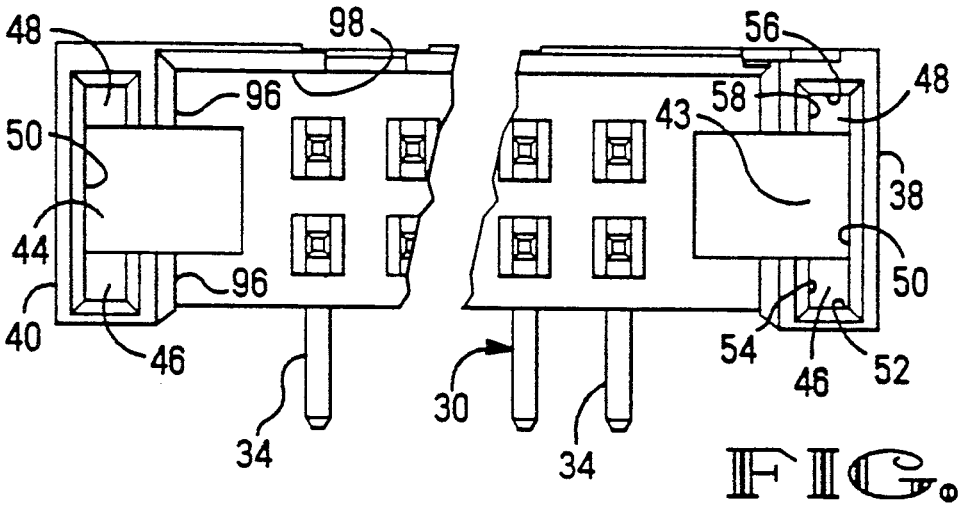
FIG. 2 is an enlarged front view of the right angle pin header showing the channels for receiving the blind mate assist shroud latch.

Formed adjacent to end walls 38 and 40 are channels 43 and 44. As best seen in FIGS. 1 and 2, each of channels 43 and 44 are themselves a pair of spaced channels 46,48. Channel 46 is defined between inner end wall surface 50, lower inner surface 52 and surface 54. Channel 48 is defined between inner end wall surface 50, upper inner surface 56 and surface 58. The spacing between lower inner surface 52 and upper inner surface 56 is substantially the width of latch arm 60. Similarly, the spacing between surfaces 54 or 58 and inner end wall surface 50 is substantially the thickness of latch arm 60. Channel 44 in the preferred embodiment is substantially a mirror image of channel 43.

Pins 30 are typically 0.025 inch (0.635 mm) square on 0.100 inch (2.54 mm) centerlines both between adjacent pins in a row and between rows of pins. Pins 30 have a mating portion 32 extending upwardly from base 28 substantially the height of side wall 36 and end walls 38,40 which collectively define a shroud 62.

Figure 4:
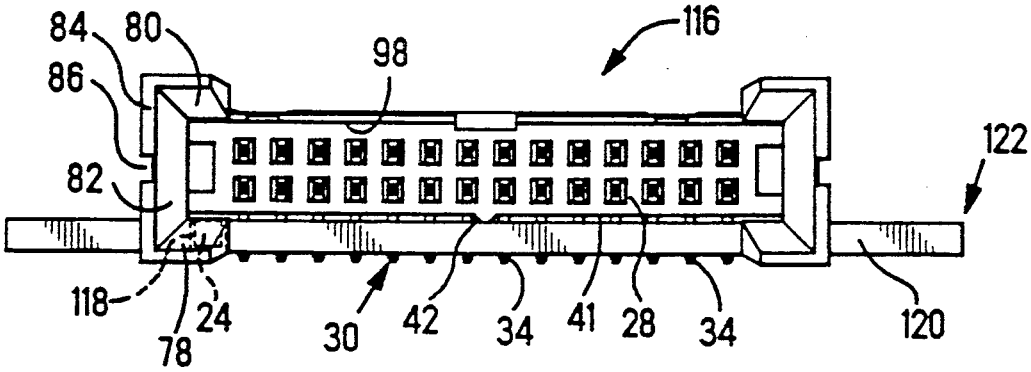
FIG. 4 is a front view of the right angle pin header assembly mounted on a circuit board.
Figure 8:
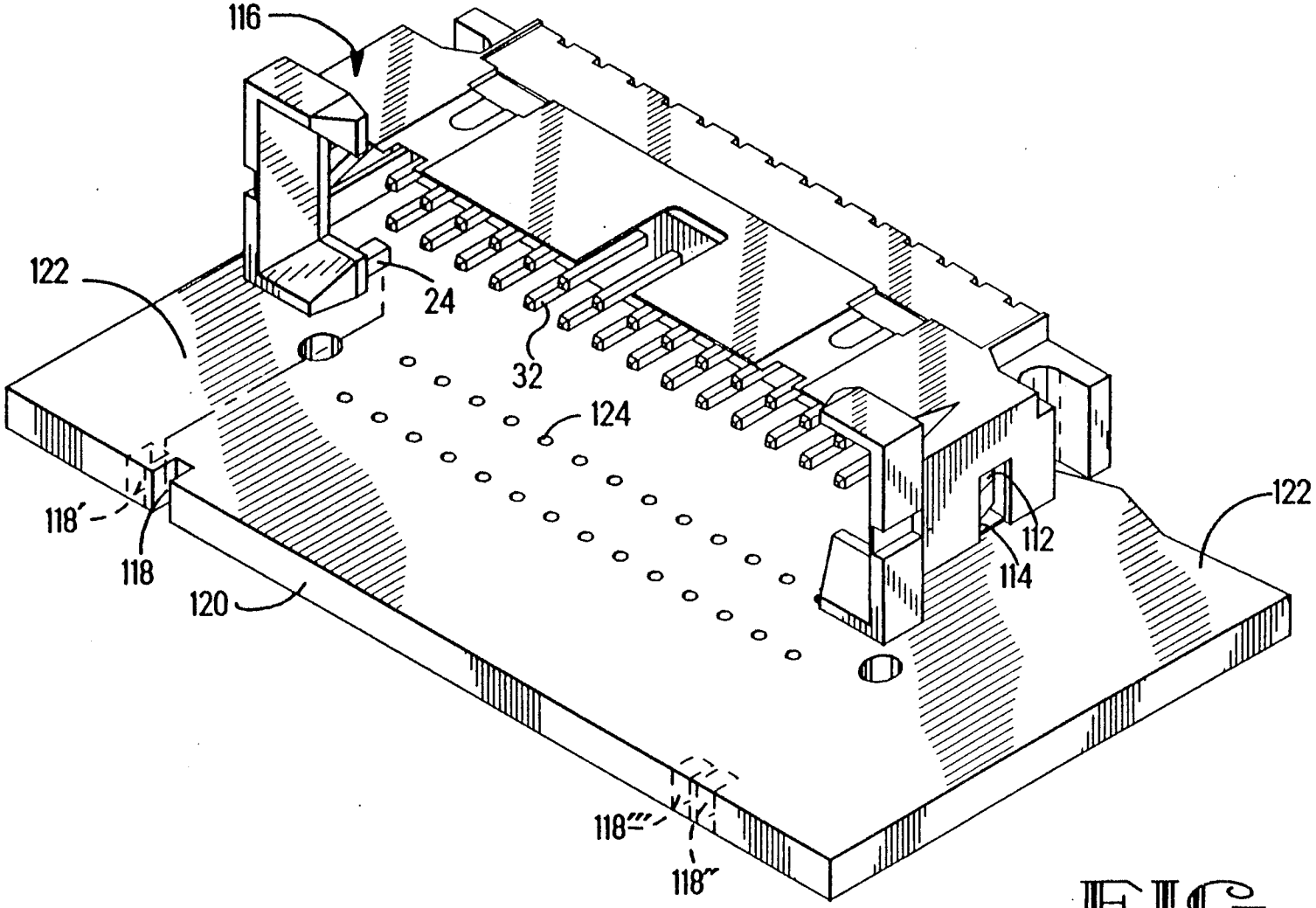
FIG. 8 is a perspective view similar to FIG. 1 with the alignment and blind mate assist shroud secured to the right angle pin header, with the right angle pin header assembly positioned above a circuit board on which the right angle pin header assembly is adapted to be mounted.

Alignment and blind mate assist shrouds 22 shown exploded from end walls 38,40 in FIG. 1, as well as secured to right angle pin header 20 in FIGS. 4 and 8 are substantially identical and therefore only one needs to be described.

Each shroud 22 is molded of a suitable plastic and consists of a body portion 64 securable to right angle pin header 20 and an extension portion 66 having a substantially U-shaped cross section adapted to extend above shroud 62 to assist in aligning a complementary connector during mating or unmating thereof with right angle pin header 20. With shroud 22 secured on right angle pin header 20, bottom surface 74 is substantially coplanar with top surface 76 of shroud 62. Side members 68 and 70 as well as end member 72 extend above top surface 76 of shroud 62 and provide beveled surfaces 78,80 and 82 respectively which taper inwardly in a direction from top surface 84 to bottom surface 74. Beveled surfaces 78,80 and 82 collectively provide lead-in for the complementary connector prior to mating with the mating portion 32 of pins 30 in right angle pin header 20. Recess 86 in end member 72 permits a core pin to be positioned during molding of shroud 22 to form latch shoulder 88. Each of beveled surfaces 78,80 and 82 extend from top surface 84, in the preferred embodiment, to respective limited height vertical surfaces 90,92 and 94. Surfaces 90,92 and 94 are substantially parallel to respective inner surfaces 96 and 98 of housing 26.

Beveled surfaces 78,80 and 82 permit a complimentary connector to initially be misaligned and guide the complementary connector to a position of alignment. As a complementary connector is moved generally in alignment with mating portion 32 of pin 30 toward right angle pin header 20 to mate therewith, the complementary connector, if not properly aligned for mating, will engage one or more of the beveled surfaces 78,80 or 82 on a shroud 22. As the complementary connector continues to move toward right angle pin header 20 for mating, reactionary forces between the complementary connector and beveled surfaces 78,80 or 82 will cause the complementary connector to align with the right angle pin header 20 prior to mating. The beveled surfaces extend into vertical surfaces 90,92 and 94 which further assure alignment prior to mating. The vertical surfaces also maintain alignment of the complementary connector with the pin header during unmating to prevent tilting or peeling of the complementary connector arcuately away from the pin header in a manner that could damage the pins. In this manner, shrouds 22 obviate the problems of misregistration and misalignment as well as bent pins that were a result of misalignment.

The body portion 64 is comprised of latch arm 60 extending from lower surface 74. Latch arm 60 has beveled corners 100 adjacent to leading edge 102 and a reinforcing rib 104 upstanding from inward surface 106. Outward surface 108 of latch arm 60 has a latch protrusion 110 upstanding therefrom near leading edge 102. Protrusion 110 has a latch shoulder 88 facing extension portion 66 and a ramp surface 112 inclined upwardly from surface 108 at leading edge 102. The extension portion 66 may have a recess 86 for positioning a core pin during molding of shroud 22 to form latch shoulder 88.

One or both of the alignment and blind mate assist shrouds 22 associated with a right angle pin header 20 has a polarization or keying protrusion 24 extending from bottom surface 74 away from extension portion 66 in the general direction of body portion 64. The function of the polarization or keying protrusion 24 will be discussed in greater detail below.

Blind mate assist shrouds 22 are secured to right angle pin header 20 by aligning latch arm 60 with respective channels 43,44 as shown in FIG. 1. Alignment and blind mate assist shrouds 22 are moved toward right angle pin header 20. As leading edge 102 is received in a channel 43,44, beveled corners 100 assist in positioning of the latch arm 60 in a respective channel.

Figure 3:
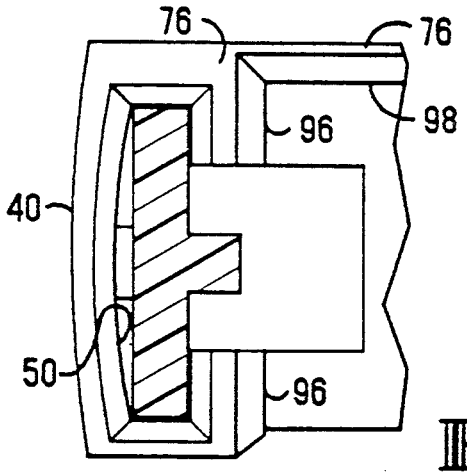
FIG. 3 is an enlarged view in a channel as a shroud is secured to the header showing the end wall resiliently deflected outwardly and the latch in cross section.

With continued movement of alignment and blind mate assist shrouds 22 toward right angle pin header 20, ramp surface 112 engages inner end wall surface 50, pushes inner surfaces 106 against surfaces 54 and 58, and resiliently deforms the end walls 38 and 40 as illustrated in FIG. 3. When latch shoulder 88 passes latch surface 114 in an end wall of housing 26, the end wall resiles inwardly to secure alignment and blind mate assist shroud 22 on right angle pin header 20 as shown in FIGS. 4 and 8. Latch shoulder 88 is spaced from bottom surface 74 substantially the same distance that latch surface 114 is spaced from top surface 76 of shroud 62. Thus, with alignment and blind mate assist shrouds secured to right angle pin header 20, bottom surface 74 of the extension portion 66 of an alignment and blind mate assist shroud 22 is substantially coplanar with top surface 76 of shroud 62.

Each right angle pin header 20 with two alignment and blind mate assist shroud 22 comprises a connector assembly 116 mountable to a circuit board 122. Polarization or keying protrusion 24 can take substantially any shape and extends from bottom surface 74 of at least one of the alignment and blind mate assist shrouds of assembly 116.

As best seen in FIG. 4, at least a portion of rear surface 74 extends below mounting face 41. Furthermore, when right angle pin header 20 is mounted on circuit board 122, the plane formed by top surface 76 of shroud 62 is typically coextensive or outward from the plane of edge 120 such that that portion of extension section 66 below mounting face 41 does not interfere with the circuit board 122. Protrusion 24 extends from rear surface 74 such that protrusion 24 is received in a notch 118 in edge 120 of circuit board 122 when pin header 20 is mounted on the circuit board.

As best seen in FIG. 8, protrusion 24 extends from shroud 22 of assembly 116 at a location to be received in a notch 118 of an edge of circuit board 122 on which assembly 116 is mounted when solder tail portions 34 of pins 30 are received in plated through holes 124. In this manner, the plated through holes, which form an array, are at a predetermined location in the circuit board relative to the notch. Protrusions 24 extend beyond the mounting face 41 and any standoffs 42 sufficiently to prevent the mating face proximate the protrusion from seating against circuit board 122 even if solder tail portions 34 start to pilot into plated through holes 124 if an assembly 116 is positioned at an assembly receiving location on circuit board 122 not intended for that particular assembly.

Figure 5:
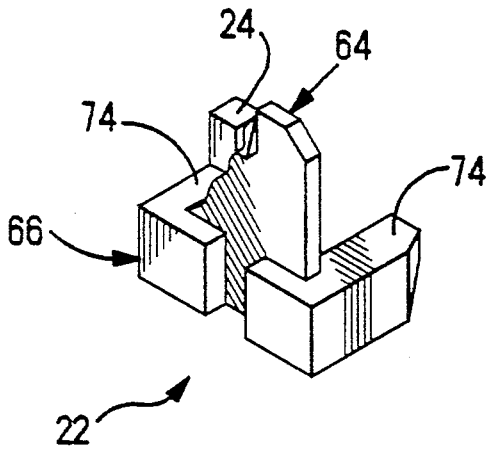
FIG. 5 is a rear perspective view of an alignment and blind mate assist shroud, with the latch arm partially cut away, showing one possible location for a polarization and keying protrusion.
Figure 6:
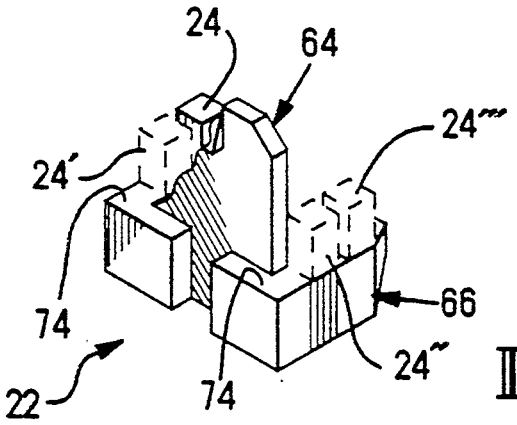
FIG. 6 is a rear perspective view of an alignment and blind mate assist shroud, with the latch arm partially cut away, showing in phantom other possible locations for a polarization or keying protrusion.
Figure 7:
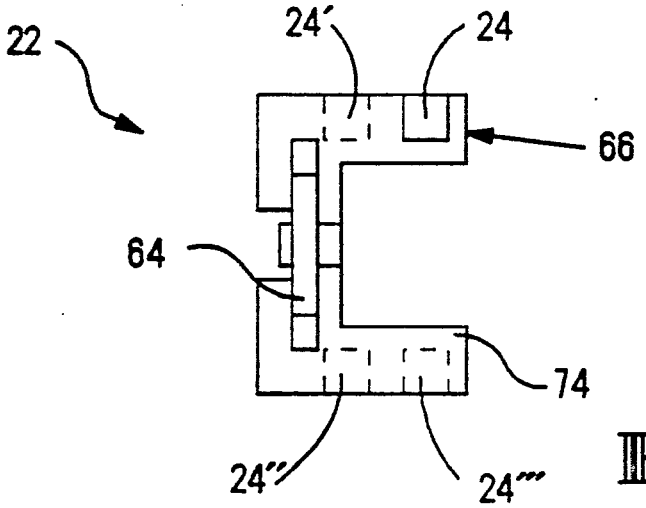
FIG. 7 is an enlarged rear plan view of the alignment and blind mate assist shroud of FIG. 6 including the possible locations of polarization protrusions, some of which are shown in phantom.

FIG. 5 shows a rear perspective view, partially cut away, of an alignment and blind mate assist shroud with a protrusion 24 at a particular location on bottom surface 74. FIG. 6 shows a rear perspective view of an alignment and blind mate assist shroud with a protrusion 24 at the same location as in FIG. 5 and further with three additional possible locations for protrusion 24, shown in phantom as protrusions 24',24'' and 24'''. FIG. 7 is an enlarged plan view of the alignment and blind mate assist shroud 22 shown in FIG. 6 (not partially cut away) showing more clearly the possible locations of a polarization protrusion on rear surface 74.

In the preferred embodiment, only one protrusion is employed on each shroud, however, the invention is not limited thereto. Each side member 68 or 70, positioned below mounting face 41, may contain a protrusion 24 and the other side member on the same alignment and blind mate assist shroud 22 may have a protrusion at the same position opposite a center line so that only a single alignment and blind mate assist shroud 22 would have to be molded to provide a particular polarization or keying protrusion arrangement. Since any polarization or keying protrusion that is positioned proximate side wall 36 is nonfunctional as it does not cooperate with a notch in a printed circuit board, advantage can be taken of the symmetry of the shroud. In this manner, a shroud 22 could be provided with protrusion 24 and 24''' at both ends of the right angle pin header. Another assembly could have shrouds with protrusions at 24' and 24'' at opposite ends of pin header 20. Four possible protrusion locations are thus defined on bottom surface 74 proximate the mounting face and four corresponding unique shrouds are defined with only a single protrusion 24,24',24'' or 24''' being employed on each shroud 22 in the preferred embodiment.

In this manner, shrouds of a particular color can be manufactured with a protrusion at a particular one of the possible locations to overcome the aforementioned problem and to assure that each assembly is mounted at the corresponding one of several possible assembly receiving locations along edges of the circuit board. When a pair of shrouds having protrusions thereon are received on a right angle pin header 20 the protrusions are spaced to be received in corresponding notches 118,118',118'' and 118''' in edge 120 of circuit board 122. The pair of protrusions on shrouds 22 provide a keying function that permits an assembly 116 to be mounted on circuit board 122 and be seated with the mounting face thereagainst when the respective protrusions align with and are received in the respective notches in the edge of the circuit board on which the assembly is to be mounted. As solder tail portions 34 are received in plated through holes 124, the pair of protrusions prevent an assembly 116 from mounting to and seating against board 122 when the protrusions do not align with notches 118 in board 122. When the protrusion are properly keyed to the location that receives an assembly, in addition to the solder tail portions 34 being received in plated through holes 124, protrusions are received in respective spaced notches 118. For example when shrouds 22 have protrusions 24 and 24''' therein, protrusion 24 is received in notch 118 and protrusion 24''' is received in notch 118'''. While all combinations of the presence of protrusions 24,24',24'' and 24''' on both of the shrouds 22 of an assembly have not been shown, it is understood that the protrusions may be present in any combination.

Polarization per se is not required in this application as it is known the mating portion of pins 30 extend toward the periphery of the circuit board on which the connector is mounted. One or more protrusions can be used to key the connector to a particular connector receiving location on the board.

In this manner a protrusion on shroud 22 of assembly 116 provides an assembly-to-board keying function that permits assembly 116 to be mounted on circuit board 122 and be seated thereagainst when the protrusion is receivable in a respective notch in the board on which the assembly is to be mounted. As solder tail portions 34 are received in plated through holes 124, the protrusion prevents at least one end of the assembly from mounting to and seating against board 122 when the protrusion does not align with a notch in the circuit board. When the protrusion is properly keyed to the circuit board location that receives an assembly, in addition to the solder tail portions being received in plated through holes 124, protrusion 24 is received in a corresponding notch in an edge of the circuit board.

Figure 9:
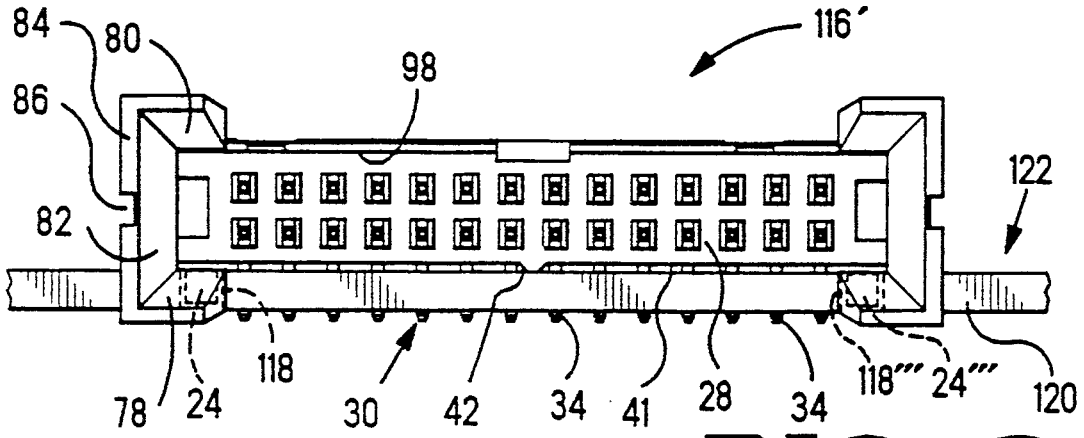
FIG. 9 is an alternate embodiment assembly in which each alignment and blind mate assist shroud has a polarization or keying protrusion thereon.

FIG. 9 shows an alternate embodiment assembly 116' in which the alignment and blind mate assist shrouds 22 have a protrusion 24 or 24''' thereon which cooperate with and are received in notches 118 and 118''' on circuit board 122.

Figure 10:
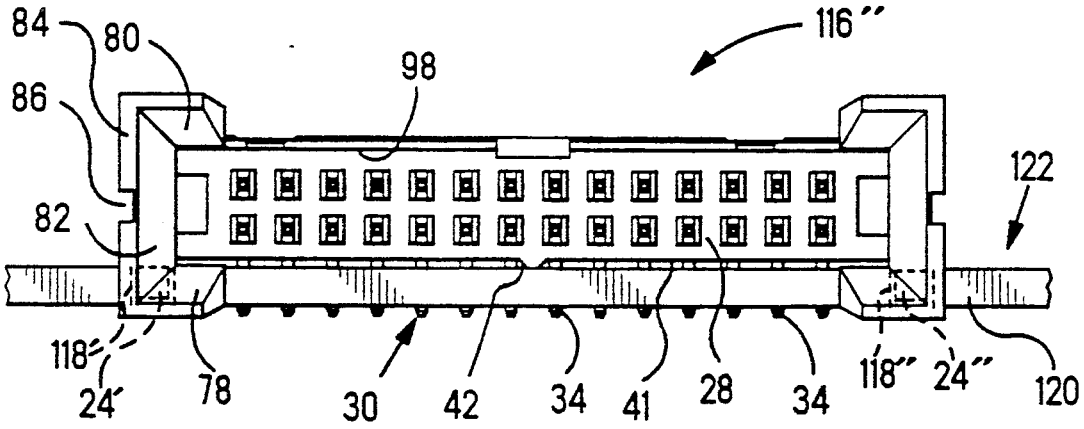
FIG. 10 is an another alternate embodiment assembly in which the alignment and blind mate assist shrouds have polarization and keying protrusions that are at a different location than is shown in FIG. 9.

FIG. 10 shows another alternate embodiment assembly 116'' in which the alignment and blind mate assist shrouds 22 have a protrusion 24' or 24'' thereon which cooperate with and are received in notches 118' and 118'' on circuit board 122.

Figure 11:
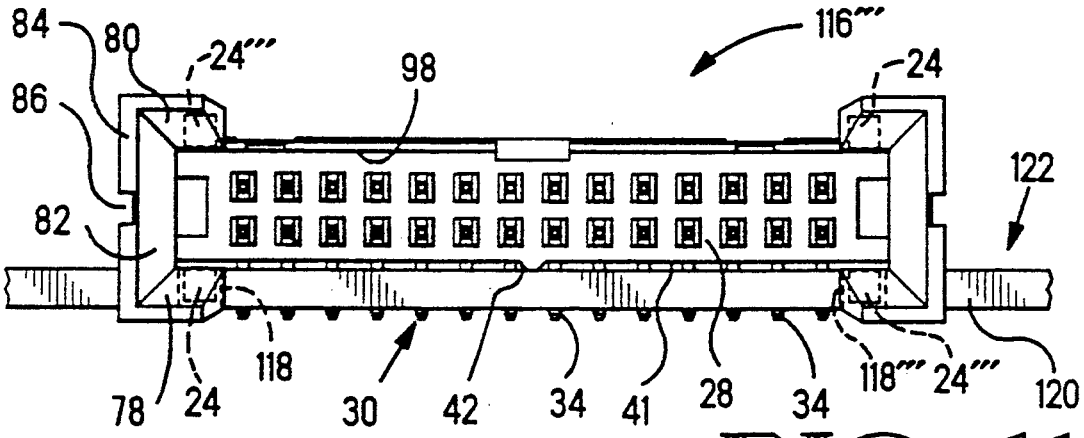
FIG. 11 is yet another alternate embodiment assembly similar to the assembly shown in FIG. 9 wherein the alignment and blind mate assist shrouds are identical.

FIG. 11 shows yet another alternate embodiment assembly 116''' in which the alignment and blind mate assist shrouds 22 are identical.

While the invention has been described with respect to an electrical connector assembly having pins for being received in plated through holes, the invention could be used with an electrical connector assembly for surface mounting.

I claim:

1. An electrical connector assembly for mounting on a circuit board having an edge with at least one notch therein at a selected one of several predetermined locations and an array of plated through holes in a predetermined location relative to said notch, the assembly comprising:

a shrouded header having at least two walls extending to a planar surface, said at least two walls defining inner surfaces, the shrouded header having a plurality of contacts secured therein, said contacts having a first section extending substantially perpendicular to the planar surface and a second section extending substantially perpendicular thereto, said second section extending beyond a mounting face; and at least one alignment and blind mate assist shroud secured to said shrouded header, said shroud having a body section and an extension section, said body section having a latch which engages said shrouded header for securing the shroud on the shrouded header, said extension section extending beyond said planar surface, said extension section having guide means tapering inwardly toward said inner surfaces for guiding a complementary connector into said shrouded header, said extension section having a protrusion extending toward said body section at a selected one of several predetermined locations, said protrusion adapted to be received in the notch in the edge of the circuit board when said assembly is mounted on said board with the second sections of said contacts received in the array of plated through holes whereby the electrical connector assembly is keyed to the circuit board when the second sections of the contacts are receivable in the array of through holes and the selected predetermined location of the protrusion corresponds to the selected predetermined location of the notch in the edge of the circuit board.

2. An electrical connector assembly as recited in claim 1, wherein the shrouded header further comprises at least one latch receiving recess, each said latch receiving recess including a pair of spaced channels defining pairs of closely spaced opposed surfaces to receive said latch therebetween.

3. An electrical connector assembly as recited in claim 2, wherein the shrouded header further comprises a latch surface on a wall thereof, said latch defining a latch shoulder to engage the latch surface and thereby secure the at least one shroud to the shrouded header.

4. An electrical connector assembly as recited in claim 1, wherein a guide means comprises beveled surfaces.

5. An electrical connector assembly as recited in claim 1, wherein the extension section further comprises an alignment surface between said guide means and said planar surface, said alignment surface extending coplanar to at one of said inner surfaces.

6. An electrical connector assembly for mounting on a circuit board having an edge with at least one notch therein at a selected one of several predetermined locations and an array of plated through holes at a predetermined location relative to said notch, the assembly comprising:

a shrouded header having at least two walls extending to a planar surface, said at least two walls defining inner surfaces, the shrouded header having a plurality of contacts secured therein, said contacts extending substantially to the planar surface, at least one latch receiving recess, each said latch receiving recess including a pair of spaced channels defining pairs of closely spaced opposed surfaces; and at least one alignment and blind mate assist shroud secured to said header, said shroud having a body section and an extension section, said body section having a latch received in said at least one latch receiving recess, said latch engaging said shrouded header for retaining the shroud on the shrouded header, said extension section extending beyond the planar surface, said extension section having guide means tapering inwardly toward said inner surfaces for guiding a complementary connector into said shrouded header, said extension section having a protrusion extending toward said body portion at a selected one of several predetermined locations, said protrusion adapted to be received in the notch in the edge of the circuit board when said assembly is mounted on said board with a portion of said contacts received in the array of plated through holes whereby the electrical connector assembly is keyed to the circuit board when the second sections of the contacts are receivable in the array of through holes and the selected predetermined location of the protrusion corresponds to the selected predetermined location of the notch in the edge of the circuit board.

7. An electrical connector assembly as recited in claim 6, wherein the shrouded header further comprises a latch surface on a wall thereof, said latch defining a latch shoulder to engage the latch surface and thereby secure the at least one shroud to the shrouded header.

8. An electrical connector assembly as recited in claim 6, when the contacts are formed to have two portions substantially perpendicular to each other.

9. An electrical connector assembly as recited in claim 6, wherein the guide means comprise beveled surfaces.

10. An electrical connector assembly as recited in claim 6, wherein the extension section further comprises an alignment surface between said guide means and said planar surface, said alignment surface extending coplanar to at least one of said inner surfaces.

11. An electrical connector assembly for mounting on a circuit board having an edge with at least one notch therein at a selected one of several predetermined locations and an array of plated through holes at a predetermined location relative to said notch, the assembly comprising:

a shrouded header having at least two walls extending to a planar surface, said at least two walls defining inner surfaces, the shrouded header having a plurality of contacts secured therein, said contacts extending substantially to the planar surface; and a pair of alignment and blind mate assist shrouds, each of said shrouds secured to one of said at least two walls, each said shroud having a body section having a latch which engages said shrouded header for securing the shroud on the shrouded header, each shroud having an extension, each extension section extending beyond the planar surface, each extension section having guide means tapering inwardly toward said inner surfaces for guiding a complementary connector into said shrouded header, each said extension section having a protrusion extending toward said body section at a selected one of several predetermined locations, said protrusion adapted to be received in the notch in the edge of the circuit board when said assembly is mounted on said board with portions of the contacts received in the array of plated through holes whereby the electrical connector assembly is keyed to the circuit board when the second sections of the contacts are receivable in the array of through holes and the selected predetermined location of the protrusion corresponds to the selected predetermined locations of the notch in the edge of the circuit board.

12. An electrical connector assembly as recited in claim 11, wherein the contacts have two portions substantially perpendicular to each other.

13. An electrical connector assembly as recited in claim 11, wherein the guide means comprise beveled surfaces.

14. An electrical connector assembly as recited in claim 13, wherein a beveled surface on each shroud extends inwardly toward said inner surfaces and toward a beveled surface on the other shroud.

15. An electrical connector assembly as recited in claim 11, wherein the extension section of each shroud further comprises an alignment surface between respective guide means and said planar surface, said alignment surface extending coplanar to at least one of said inner surfaces.

* * * * *